US007887695B2

(12) United States Patent
Erwin et al.

(10) Patent No.: US 7,887,695 B2
(45) Date of Patent: Feb. 15, 2011

(54) FUELS FOR HOMOGENOUS CHARGE COMPRESSION IGNITION ENGINES

(75) Inventors: Jimell Erwin, San Antonio, TX (US); Thomas W. Ryan, III, San Antonio, TX (US); Rudolf H. Stanglmaier, Fort Collins, CO (US)

(73) Assignee: Southwest Research Institute, San Antonio, TX (US)

( * ) Notice: Subject to any disclaimer, the term of this patent is extended or adjusted under 35 U.S.C. 154(b) by 0 days.

(21) Appl. No.: 12/858,983

(22) Filed: Aug. 18, 2010

(65) Prior Publication Data

US 2010/0307439 A1 Dec. 9, 2010

Related U.S. Application Data

(63) Continuation of application No. 10/245,891, filed on Sep. 18, 2002, now abandoned.

(60) Provisional application No. 60/322,757, filed on Sep. 18, 2001.

(51) Int. Cl.
*F02B 43/00* (2006.01)
*F02B 3/00* (2006.01)
*C10L 1/08* (2006.01)

(52) U.S. Cl. ..... 208/15; 123/1 A; 123/294; 123/295; 585/14

(58) Field of Classification Search ..... 123/1 A, 123/295, 294; 208/15; 585/14
See application file for complete search history.

(56) References Cited

U.S. PATENT DOCUMENTS 4,541,835 A * 9/1985 Norton et al. ..... 44/326
4,645,585 A * 2/1987 White ..... 208/58
5,117,800 A * 6/1992 Watson et al. ..... 123/575
5,259,851 A * 11/1993 Genova et al. ..... 44/302
5,389,111 A * 2/1995 Nikanjam et al. ..... 44/300
5,389,112 A * 2/1995 Nikanjam et al. ..... 44/300
5,749,928 A * 5/1998 Epperly et al. ..... 44/358
5,752,989 A * 5/1998 Henly et al. ..... 44/347
5,755,833 A * 5/1998 Ishida et al. ..... 44/333
5,782,937 A * 7/1998 Colucci et al. ..... 44/324
5,806,483 A * 9/1998 Mitarai et al. ..... 123/299
5,813,224 A * 9/1998 Rao et al. ..... 60/274
5,832,880 A * 11/1998 Dickey ..... 123/25 C
5,837,016 A * 11/1998 Ishida et al. ..... 44/333
5,928,393 A * 7/1999 Ishida et al. ..... 44/387
5,931,977 A * 8/1999 Yang ..... 44/320
5,947,063 A * 9/1999 Smith et al. ..... 123/3
5,967,100 A * 10/1999 Firey ..... 123/27 GE
5,984,984 A * 11/1999 Ahmed ..... 44/412
6,004,361 A * 12/1999 Barry et al. ..... 44/413
6,010,544 A * 1/2000 Haldeman et al. ..... 44/301
6,090,170 A * 7/2000 Yun et al. ..... 44/433
6,113,661 A * 9/2000 Germanaud et al. ..... 44/444
6,116,207 A * 9/2000 Firey ..... 123/250
6,119,664 A * 9/2000 McCandless ..... 123/527
6,210,563 B1 * 4/2001 Tsao et al. ..... 208/138
6,264,827 B1 * 7/2001 Okazaki et al. ..... 208/57
6,273,076 B1 * 8/2001 Beck et al. ..... 123/679
6,276,334 B1 * 8/2001 Flynn et al. ..... 123/435
6,286,482 B1 * 9/2001 Flynn et al. ..... 123/435
6,309,432 B1 * 10/2001 Wittenbrink et al. ..... 44/436
6,461,497 B1 * 10/2002 Pedersen ..... 208/15
6,463,907 B1 * 10/2002 Hiltner ..... 123/304
6,550,430 B2 * 4/2003 Gray ..... 123/27 GE
6,561,157 B2 * 5/2003 zur Loye et al. ..... 123/295
6,656,343 B2 * 12/2003 Dancuart ..... 208/58
6,663,767 B1 * 12/2003 Berlowitz et al. ..... 208/15
6,684,849 B2 * 2/2004 zur Loye et al. ..... 123/295
2004/0149255 A1 * 8/2004 zur Loye et al. ..... 123/295

OTHER PUBLICATIONS

Christensen et al., Demonstrating the Multi Fuel Capability of a Homogeneous CHarge Compression Ignition Engine with Variable Compression Ratio, SAE Technical Papers, pp. 1-15 (Oct. 1999).*

* cited by examiner

*Primary Examiner*—Ellen M McAvoy
(74) *Attorney, Agent, or Firm*—Grossman, Tucker et al.

(57) ABSTRACT

A fuel for a homogeneous charge compression ignition engine having a 95 V % distilled temperature by boiling point measurement in the range of about 35.degree. C. to about 350.degree. C., a cetane number in the range of about 2 to about 120, and an octane number in the range of 10 to about 110. The invention also relates to a method of operating a homogeneous charge compression ignition engine of mixing a fuel with air and feeding the fuel into a combustion chamber.

4 Claims, No Drawings

FUELS FOR HOMOGENOUS CHARGE COMPRESSION IGNITION ENGINES

CROSS-REFERENCE TO RELATED APPLICATIONS

This application is a continuation of U.S. application Ser. No. 10/245,891 filed Sep. 18, 2002 (now abandoned), which claims the benefit of U.S. Provisional Application No. 60/322,757 filed Sep. 18, 2001.

FIELD OF INVENTION

This invention relates generally to an internal combustion engine fuel that is used in homogenous charge compression ignition (HCCI) engines, and more particularly to materials that constitute useful fuels for use in HCCI engines and variations for controlling the efficient use of the fuel in the HCCI engines.

DESCRIPTION OF RELATED ART

Air pollution has become one of the more serious problems affecting the United Sates and other countries, especially in some large urban areas where air pollution has reached critical levels. In the United States, the primary responsibility for setting and maintaining air quality standards rests on the Environmental Protection Agency (EPA). Once the standards are set, the state and local governments are responsible for determining the means of achieving the air pollution standards.

In the last century, transportation relied primarily upon the internal combustion engine to provide power for mobility. This reliance developed into a mature and well known science in the field of engineering related to the internal combustion engine. Rarely are there "new" concepts for the internal combustion engine because of the advanced stage of engine development, but alternative models are emerging. For instance, an increase in engine power or reduced size/weight may be desired, but may require both increased cost and decreased fuel efficiency of the engine.

The challenge is to balance the demands of the government in achieving higher fuel efficiency and emissions standards with consumers' demands for high engine power. The traditional vehicle engines are not able to be easily manipulated to achieve a cost-efficient balance of the competing demands. Thus, the search is now to develop new efficient engines that are able to balance new government standards with consumer demand at a cost-effective level.

The traditional combustion engines have been either the Diesel or the Otto engines. Although each engine has similar basic structures and workings, the operating properties of each differ greatly.

The Diesel engine, also known as a reciprocating piston, compression ignition engine, controls the start of combustion by timing the fuel injection. The Otto engine, also known as a rotary internal or spark ignition combustion engine, controls the start of combustion by timing the spark.

There are advantages and disadvantages of each type of engine or cycle. For example, an Otto cycle system is able to achieve much lower NOx and particulate emissions level than a diesel engine. These low levels are possible because the Otto cycle engines can take advantage of exhaust gas after treatment systems that will not work on diesel engines. However, Otto cycle engines typically have lower efficiencies than comparable diesel engines.

The diesel cycle, on the other hand, has a much higher thermal efficiency than the Otto cycle. The diesel cycle uses higher compression ratios than the Otto cycle (which are kept low to avoid "knocking"). The diesel cycle controls the power output without a throttle, therein eliminating throttling losses and achieving higher efficiency at part load. Usually diesel cycle engines do not achieve low NOx and particulate emissions. The diesel cycle requires a mixing control at a very fuel rich equivalence ratio, thereby resulting in typically higher particulate emissions.

Considering the disadvantages of each of the traditional combustion cycles, interest is now turning to a type of engine utilizing premixed charge compression ignition (PCCI), also known as homogeneous charge compression ignition (HCCI), active thermo-atmosphere combustion (ATAC), Toyota-Soken (TS), and compression-ignited homogeneous charge (CIHC). PCCI engines initiate combustion using a well premixed fuel/air mixture that is mixed in the intake port or the cylinder before actual autocompression ignition of the mixture. The actual mixture may vary from being homogeneous to less than homogeneous with some degree of stratification.

What is desired is a method and system for producing useful and efficient fuels for use in HCCI cycles. It is further desired to have a system for the efficient use of the fuel in a HCCI cycle and therein lower emissions, especially of NOx and particulate matter.

SUMMARY

This invention concerns fuels for engines that operate in a homogenous charge compression ignition (HCCI) mode, methods for defining such fuels, for the combustion of these fuels, and for regulating that combustion that engenders the successful and satisfactory operation of HCCI engines.

The ability of the HCCI engine to develop useful rotary power and to do so with lowered emissions of partially oxidized fuel and soot, and lowered emissions of nitrogen oxides than comparable displacement Otto cycle or diesel cycle depends on a suitably produced fuel. Furthermore, the Otto cycle and the diesel cycle require fuels that exclusively limit the fuel preparation process by relegating available blendstocks to one use or the other thereby restricting the optimal use of available fuel sources. The HCCI engines may use fuels from sources otherwise incompatible if assigned to fuel blends designed for Otto cycle and diesel cycle engines.

The present invention is directed to overcoming the problems set forth above. This invention sets forth the range of fuel properties for use in HCCI engines and variations for their efficient use as fuel in HCCI engines. Based upon the observations made in numerous experiments of the inventors, specific properties and relations among the properties were discerned and are set forth herein.

In particular, over 500 engine experiments were performed using a wide variety of fuels in a successful effort to determine the important fuel properties and to define the limits for these properties as specified in this patent.

DETAILED DESCRIPTION

The fuels, deriving from the various exemplary embodiments of the present invention, leave the liquid phase upon introduction into the appropriate locations in the intake manifold or the combustion chamber and become vapor (or gas), or nearly totally vaporize, before the onset of the combustion event. Once exposed through elevation of temperatures and pressure to the conditions required for the onset of autoignition, the air-fuel mixture begins to react and completes combustion before extreme temperatures are reached that lead to greater formation of nitrogen oxides. At the same time, the air-fuel mixture resists the overly rapid combustion that produces premature ignition that is counterproductive and damaging to the engines.

While there are several different names for this type of process and several different methods available to control and initiate this type of reaction, they all share the common features of premixing some, or all, of the fuel and compression heating initiation of the reaction. This type of reaction will be referred to herein as HCCI irrespective of other names by which it might be called such as Premixed Charge Compression Ignition (PCCI or PMCCI), Controlled Auto Ignition (CAI), Premixed Charge Compression Reaction Engines (PCCRE), and other names. The distinguishing feature of these combustion modes is that a fraction of the fuel is introduced into the combustion chamber prior to the start of combustion, and that this fuel-air mixture is ignited by compression. That is, ignition is achieved without the aid of a spark plug or other active ignition sources (although the use of passive ignition aides such as glow-plugs, surface heaters, or catalytic coatings are covered within the scope of these combustion modes). The fuel can be introduced either upstream of the intake valves (through carburetors, port-fuel injectors, mixers, etc.), or directly in cylinder through the use of direct fuel injectors.

The fundamental HCCI characteristics are that a large majority of the fuel is premixed with the air to form a combustible mixture throughout the combustion chamber, and combustion initiates by compression.

U.S. Pat. No. 6,273,076 to Beck et al. (hereinafter "Beck"), incorporated herein in its entirety, describes the general concept of homogeneous charge compression ignition engines and an improved performance by optimizing an excess air ratio and/or intake air charge temperature. However, Beck does not describe or suggest any particular fuels for homogeneous charge compression ignition engines other than identifying that the fuel should be compression ignitable.

U.S. Pat. Nos. 6,276,334 and 6,286,482, both to Flynn et al. and both incorporated herein in their entirety, describe some of the hardware aspects of homogeneous charge compression ignition engines. The Flynn patents also describe a limited number of fuel characteristics and the possible reactivity control achieved by mixing fuels. However, the Flynn patents do not teach any particular fuel properties for homogeneous charge compression ignition engines.

The HCCI cycle is not greatly affected by the fuel timing delivery as compared to a diesel cycle. The well mixed and nearly homogeneous fuel/air mixture of the HCCI delivers fewer emissions as opposed to the diesel cycle, and offers potentially excellent fuel efficiency.

Both the Otto and diesel cycles require fuels exclusively designed for use in their respective engines. HCCI engines, however, require fuels coming from otherwise incompatible fuel blends if designed for Otto or diesel cycles.

The description of the various exemplary embodiments of the present invention herein are intended to describe the preferred novel fuels for running an HCCI engine at an optimum level of efficiency and practicality. However, fuels typically fed into Otto cycle engines such as gasoline, having ignition qualities of octane numbers centered on the range of anti-knock index 83 to 97 associated with a usual boiling point range of 30° C. to 225° C. and diesel cycle engines such as a diesel fuel having ignition qualities of cetane numbers centered on the range of 30 to 48 associated with the approximate boiling point range of 175° C. to 340° C. may also be fed into HCCI engines. However, feeding conventional Otto and diesel cycle fuels into an HCCI engine typically will decrease efficiency of the engine and increase emissions outputs of pollutants. Thus, feeding conventional Otto or diesel cycle fuels into a HCCI cycle engine is not optimal for efficiency and environmental concerns, but can nonetheless be performed.

Further, various exemplary embodiments of the invention comprise engine cycles wherein there is a single combustion event and multiple combustion events wherein at least one of them can be exemplified as HCCI.

For the optimum use of the HCCI fuels, the orderly operation of the HCCI engines may depend on which engine configuration is selected. For example, through the careful regulation of the incoming fuel-air charge, including temperature and pressure, an efficient match of the engine operation with the fuel constitution is achieved. Consistent with fuels chosen and operating mode, other governors of combustion may be used including, for example, ignition initiators, auxiliary fuel injectors, compression ratio variation, exhaust gas recirculation (EGR) or inert gas introduction, or variable valve timing strategies to enhance the HCCI engine operation.

In accordance with various exemplary embodiments of the invention, the properties of the preferred novel HCCI fuels are so arranged to minimize the engine-out or vehicle-out emissions of pollutants including, for example, CO, various hydrocarbons, carbon-containing particles, nitrogen oxides, and the like. Further, the boiling point range, boiling point distribution, volatility, and ignition indices may be configured to simultaneously minimize the production of the designated pollutants. The engine operating mode to befit these fuel compositions includes, for example, increased intake charge temperature, fuel-air ratio, speed, and intake charge temperature, wherein each is selected to control the onset of combustion and to produce more complete combustion at lower adiabatic flame temperatures.

In accordance with other various exemplary embodiments of the present invention, the properties of the fuels are so arranged to allow for maximizing the total efficiency of energy production, considering the intrinsic efficiency of the fuels combusting in the engine and the production of the fuels themselves. The specified properties include, for example, but are not limited to, the boiling point range, boiling point distribution, volatility, and ignition indices chosen to incorporate a variety of blendstocks including, for example, petroleum-derived stocks like straightrun naphtha, dehexanizer effluents, cracked stocks, distillate stocks, polymer and other gasoline, and other refinery stocks, whether directly derived from the refinery source or the object of further processing. For example, these may include isomerization and other composition-altering steps; and hydrocarbon stocks like natural gasoline, gasifier liquids, synthesized components whether from degradatory processing, e.g., destructive distillation of natural products or wastes or synthetic processing, e.g., Fischer-Tropsch synthesis or other synthetic processes; non-petroleum sources like alcohols, various oxygenates, and other stocks having more atomic species than carbon and hydrogen; and additive compounds like octane number altering constituents and cetane number changing constituents.

According to exemplary embodiments of the invention, an internal combustion engine fuel suitable for use in an HCCI mode preferably comprises one or more of the properties listed hereafter.

The engine fuel can have an evaporative nature or characteristic, sufficient to allow essentially all the fuel in each intake charge to convert to a vapor phase before the onset of combustion. The fuel can have an ignition delay sufficiently long that the onset of combustion shall be achieved by the engine fuel after the moving piston has exceeded the point of maximum mechanical compression in the movement cycle. Further, the engine fuel may have an ignitability sufficiently high that uniform continuous combustion is achieved throughout the fuel-air charge filling the piston cylinder once ignition commences.

The preferred engine fuel used in accordance with the exemplary embodiments of the present invention preferably comprises a fuel having:

(1) a boiling temperature range such that the 95% ASTM D 86 boiling points are about 35° C. to about 350° C., preferably about 180° C. to about 350° C., more preferably about 225° C. to about 350° C.;

(2) a cetane number as measured by ASTM D 613 or similar measurement of ignition characteristics, of about 2 to about 170, preferably 2 to about 70, more preferably 20-70, wherein the cetane number is based on a mixture of hydrocarbons, oxygenates, and/or other major blending components. Further, the cetane number can be, but is not necessarily, influenced by the addition of one or more minor components and/or additives that can change the cetane number;

(3) an octane number as measured by antiknock index defined in ASTM D 4814 or similar measurement of ignition characteristics, of about 10 to about 110, preferably 12 to about 110, more preferably about 12 to 82, wherein the octane number is based on a mixture of hydrocarbons, oxygenates, and/or other major blending components.

An alternative method for measuring the ignition characteristics of the fuel embodied in this invention, the elevated pressure autoignition temperature (EPAIT), may also be used to characterize the possible and preferred fuels for HCCI engines. The method is described by Ryan and Matheaus (Ryan, T. W., III and Matheaus, Andrew C, "Fuel Requirements for HCCI Engine Operation", Thiesel 2002, Valencia, Spain, Sep. 11-14, 2002), incorporated herein in its entirety, in its details leading to the present invention. The important characteristics for an HCCI fuel are ignition delay time and temperature at the start of reaction. Both characteristics are measured in the process of determining EPAIT. The fuels of the invention possess EPAIT in the range of 400° C. to 800° C.

In various exemplary embodiments of the present invention, when the cetane number of the fuel is from about 47 to about 170, the octane number is preferably from about 2 to about 24. In other various exemplary embodiments of the present invention, when the cetane number of the fuel is from about 20 to about 70, the octane number is preferably from about 12 to about 82. In yet other various exemplary embodiments of the present invention, when the cetane number of the fuel is from about 2 to about 20, the octane number is preferably from about 63 to about 110.

According to exemplary embodiments of the invention, the engine fuel can be utilized to work in combination with one or more engine control and design features including, for example, an engine equipped with variable compression ratio, an engine equipped with variable valve timing, a variable or fixed exhaust gas recirculation (EGR), a variable intake mixture temperature and a variable fuel temperature.

The systems for controlling the efficient use of the engine fuel can be implemented as a programmed general purpose computer in accordance with exemplary embodiments of the invention. It will be appreciated by those skilled in the art that the controller can be implemented using a single special purpose integrated circuit, for example, an application specific integrated circuit (ASIC), having a main or central processor section for overall, system-level control, and separate sections dedicated to performing various different specific computations, functions and other processes under control of the central processor section. The controller can be a plurality of separate dedicated or programmable integrated or other electronic circuits or devices, e.g., hardwired electronic or logic circuits such as discrete element circuits, or programmable logic devices (PLDs) or the like.

While the exemplary embodiments of the invention have been described with reference to preferred aspects thereof, it is to be understood that the invention is not limited to the preferred aspects or constructions. To the contrary, the invention is intended to cover various modifications and equivalent arrangements. In addition, while exemplary aspects of the invention are described, other combinations and configurations are also within the spirit and scope of the invention.

What is claimed is:

1. A method for operating a homogenous charge compression engine having a piston and cylinder for mechanical compression comprising:

supplying a hydrocarbon feedstock wherein said fuel is characterized by having all of the following properties:

(1) a 95% ASTM D 86 boiling point of about 35° C. to about 350° C.;

(2) a cetane number in the range of about 2-20;

(3) an octane number in the range of about 63-110;

(4) an elevated pressure autoignition temperature (EPAIT) of about 400° C. to about 800° C.; and wherein essentially all of said fuel is further characterized as capable of converting to a vapor phase before combustion onset in said homogeneous charge compression engine and said fuel has an ignition delay such that the onset of combustion is achieved by said fuel after said piston has exceeded the point of maximum mechanical compression.

2. The method of claim 1 wherein said 95% ASTM D 86 boiling point is about 180° C. to about 350° C.

3. The method of claim 1 wherein said 95% ASTM D 86 boiling point is about 225° C. to about 350° C.

4. The method of claim 1 wherein said fuel having said properties comprises straightrun naphtha, dehexanizer effluents, cracked stocks, distillate stocks, polymeric hydrocarbons, or alcohol.

* * * * *